US007363668B2

(12) United States Patent
Chen

(10) Patent No.: US 7,363,668 B2
(45) Date of Patent: Apr. 29, 2008

(54) MULTIFUNCTIONAL ACTIVE CARBON COCOFIBER MATTRESS FOR LIFESAVING

(76) Inventor: Qiang Chen, 13-208, Huafu Village East, Shenzhen, Guangdong 518026 (CN)

( * ) Notice: Subject to any disclaimer, the term of this patent is extended or adjusted under 35 U.S.C. 154(b) by 251 days.

(21) Appl. No.: 11/231,720

(22) Filed: Sep. 21, 2005

(65) Prior Publication Data

US 2006/0117487 A1 Jun. 8, 2006

(30) Foreign Application Priority Data

Dec. 2, 2004 (CN) ..... 2004 1 0077316

(51) Int. Cl.
*A47C 17/00* (2006.01)
*B63C 9/08* (2006.01)
*B63C 9/28* (2006.01)

(52) U.S. Cl. ..... 5/690; 5/951; 5/722; 441/129; 441/35

(58) Field of Classification Search ..... 5/690, 5/699, 703, 705, 722, 724, 727, 732, 737, 5/739, 951; 441/129, 35

See application file for complete search history.

(56) References Cited

U.S. PATENT DOCUMENTS

| | | | | |
|---|---|---|---|---|
| 836,326 | A * | 11/1906 | Kinyon | 5/722 |
| 4,985,951 | A * | 1/1991 | Lacotte et al. | 5/722 |
| 5,138,730 | A * | 8/1992 | Masuda | 5/693 |
| 5,918,333 | A * | 7/1999 | Takashima | 5/641 |
| 6,711,766 | B2 * | 3/2004 | Monk et al. | 5/420 |
| 2005/0095936 | A1 * | 5/2005 | Jones et al. | 442/136 |

FOREIGN PATENT DOCUMENTS

| | | |
|---|---|---|
| CN | ZL 94222654.2 | 2/1996 |
| CN | ZL 95225715.7 | 2/1997 |
| CN | ZL 97229087.7 | 5/1999 |
| CN | 200410005800.9 | 2/2004 |

* cited by examiner

*Primary Examiner*—Patricia Engle
*Assistant Examiner*—Jonathan J Liu
(74) *Attorney, Agent, or Firm*—Knobbe, Martens, Olson & Bear, LLP

(57) ABSTRACT

The embodiments relate to an active carbon cocofiber mattress with the functions of floating and life saving. The embodiment can be folded to form a floating bed. The mattress core comprises prefabricated solid and rigid cocofiber mattresses with an ultra-thick sandwiched layer sandwiched therebetween; thus, when integrated as a whole, has a specific gravity of less than about 1. On said cocofiber mattress, there is provided with a high elastic cocofiber mattress. Within the ultra-thick sandwiched layer, air holes and channels filled with active carbon are provided. Active carbon layers cover the surface of the cocofiber mattress core.

10 Claims, 4 Drawing Sheets

MULTIFUNCTIONAL ACTIVE CARBON COCOFIBER MATTRESS FOR LIFESAVING

BACKGROUND OF THE INVENTION

1. Field of the Invention

The present invention relates to a mattress containing active carbon and cocofiber that can serve as a floating and life-saving device.

2. Description of the Related Art

Bedding products have been developed with individualization and diversity. Additionally, bedding products have been designed to make the one third of human life—sleeping in bed—more comfortable and healthy.

Chinese Patent No. ZL 94222654.2, *Natural Cocofiber Mattress*, discloses cocofiber materials processed by certain techniques that can be used to make bedding with cocofiber mattresses as the upper and bottom bases and a sponge sandwiched in between. The cocofiber mattress maintains a natural scent of cocofiber and prevents people from developing decubitus ulcers when the mattress is used for a long time. The mattress also has health preserving effects of relieving rheumatism, chills, etc.

Cocofibers are produced abundantly in Hainan Island, Guangxi, and Guangdong. Because of abundant raw material resources, various popular cocofiber products with excellent quality and reasonable price can be manufactured, after the manufacturing technique is improved. For example, Chinese Patent No. ZL 95225715.7, entitled *Natural Active Carbon Cocofiber Mattress* discloses advantages of cocofiber products. Chinese Patent No. ZL 97229087.7, entitled *Multifunctional Natural Cocofiber Wavy Mattress* discloses features such as air permeable, damp-proof, anti-bacterial, and deodorizing to a cocofiber mattress. Chinese Patent Application No. 2004 1000 5800.9 discloses a cocofiber mattress that can serve as floating and life saving device, which can be folded to act as a boat, with a special purpose of being a floating bed.

SUMMARY OF THE INVENTION

The embodiments provide a multifunctional mattress comprising:

a mattress core comprising an upper rigid cocofiber layer, a lower rigid cocofiber layer, an ultra-thick layer sandwiched between the upper and lower cocofiber layers, with specific gravity less than about 1;

a high elastic cocofiber layer on one of said rigid cocofiber layers;

a prefabricated active carbon layer on said mattress core; and prefabricated holes disposed within the cocofiber mattress core.

The embodiments provide a method of converting a mattress into a floating device, wherein the mattress comprises at least three regions, Regions A, B, and C, each region comprising:

a mattress core comprising an upper rigid cocofiber layer, a lower rigid cocofiber layer, an ultra-thick layer sandwiched between the upper and lower cocofiber layers, with specific gravity less than about 1;

a high elastic cocofiber layer on one of said rigid cocofiber layers;

a prefabricated active carbon layer on said mattress core; and prefabricated holes disposed within the cocofiber mattress core.

wherein Region B is adjacent to Region A on one side and adjacent to Region C on the opposite side;

wherein the method comprises:

folding Region A upwards perpendicularly from Region B;

folding Region C upwards perpendicularly from Region B; and securing the positions of Regions A and C.

DETAILED DESCRIPTION OF THE PREFERRED EMBODIMENT

Figure 1:
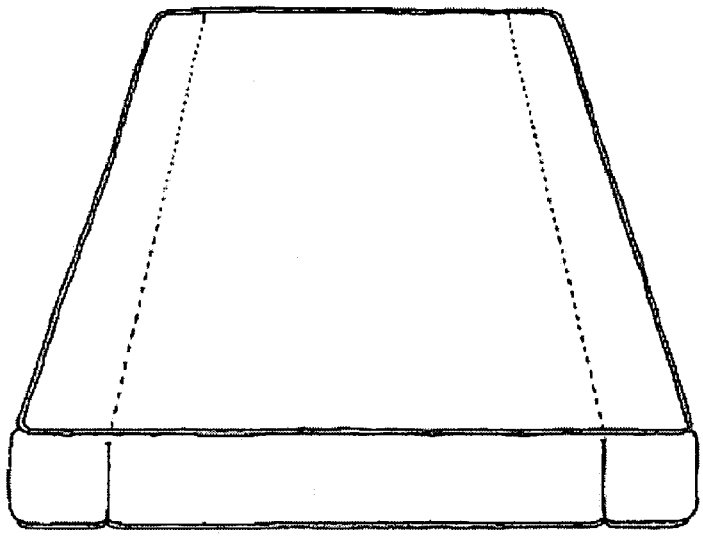
FIG. 1 is a schematic front view when an embodiment is unfolded.

The preferred embodiments comprise advantages of the above-mentioned bedding products comprising cocofiber and active carbon. At the same time, the preferred embodiments comprise improvements to the structure of the cocofiber mattress with a function of life saving. The preferred embodiments have buoyancy so as to serve as a rescuing resource in conditions, such as a natural disaster. At the same time, preferred embodiments comprise a comfortable mattress which is top grade, damp-proof, anti-bacterial, deodorizing, and air permeable.

The embodiment can be described with the following reference numerals:

1 webbing
2 prefabricated active carbon layer
3 outside packaging material
4 high elastic cocofiber mattress
5 rigid cocofiber mattress
6 sandwiched layer
7 rigid cocofiber mattress
8 outside packaging material
9 prefabricated active carbon layer
10 air hole
11 channel
12 channel
13 air hole
14 safety belt
15 safety rope
16 external cloth path
17 internal cloth path In a preferred embodiment, a thick sandwiched layer 6 is sandwiched between cocofiber mattresses 5 and 7. Preferably, the combined layers of the thick sandwiched layer and the cocofiber mattresses have a specific gravity of less than about 1. A high elastic cocofiber mattress 4 can be fitted on any of the cocofiber mattress. The embodiment can further comprise prefabricated active carbon layers 2 and 9. The embodiment can further comprise prefabricated holes within the sandwiched layer. In a preferred embodiment, the prefabricated holes within the sandwiched layer include air holes 10 and 13 and channels 11 and 12 that can be filled with active carbon.

In a preferred embodiment, the thick sandwiched layer 6 can be made of EPE (enhanced polyethylene) composite material. Within the thick sandwiched layer 6, there can be provided upright air holes 10 and 13, and channels 11 and 12 that can be filled with active carbon. The thick sandwiched layer 6 can be set between two solid and rigid cocofiber mattresses 5 and 7 and adhered thereto.

In a preferred embodiment, a high elastic cocofiber mattress 4 can be adhered to a cocofiber mattress, thereby forming a cocofiber mattress core. Preferably, the high elastic cocofiber mattress 4 is adhered to cocofiber mattress 5. Prefabricated active carbon layers 2 and 9 can cover the surface of the cocofiber mattress core, thereby forming an active carbon-cocofiber mattress core. Preferably, the prefabricated active carbon layers 2 and 9 completely cover the surface of the cocofiber mattress core.

In a preferred embodiment, the prefabricated active carbon layers 2 and 9 can be formed by selecting fine active carbon of a grain shape or a strip shape, distributing the active carbon evenly on an upper layer and a lower layer of non-woven fabric, and integrating these materials together, thereby forming a prefabricated active carbon layer.

Figure 4:
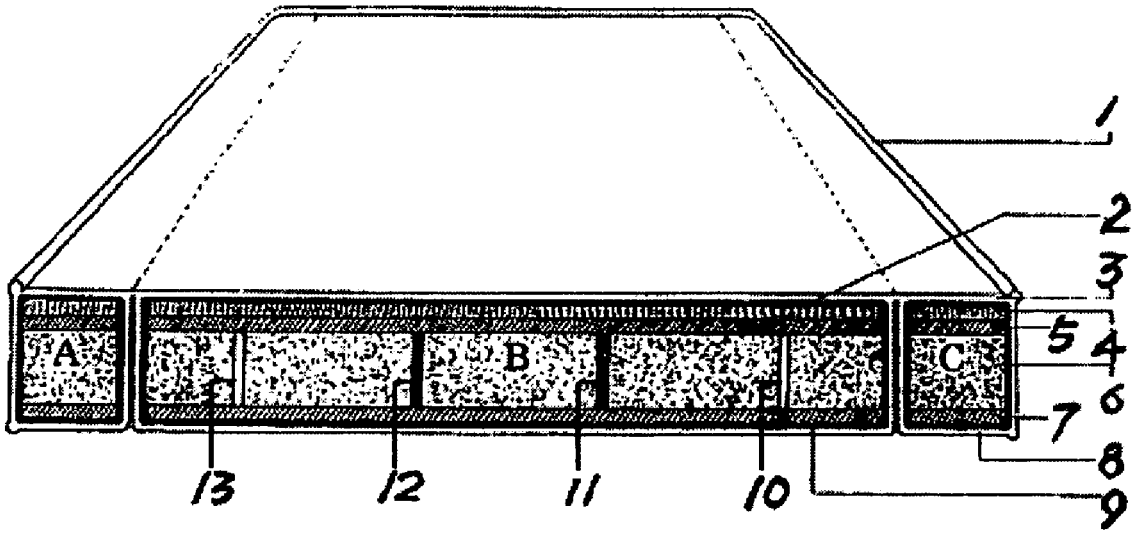
FIG. 4 is a schematic view of a structural principle of an embodiment.

In a preferred embodiment, the active carbon-cocofiber mattress core can be divided into three separate regions. With three separate regions, the preferred embodiment is a flat, foldable integrity. As shown in FIG. 4, the flat, foldable integrity can be formed by wrapping the regions with outside packaging materials 3 and 8. The outside packaging material 3 connects the three regions. The outside packaging material 8 wraps on the underside of each region and on inner sides surrounding each region. Thus, the outside packaging material 8 wraps the sides of the clefts of the active carbon-cocofiber mattress core to separate each region, namely region A, B, and C. Accordingly, the regions are connected by hinged material in which the side regions are moveable about the middle region.

In a preferred embodiment, the active carbon-cocofiber mattress core wrapped with outside packaging materials 3 and 8 can be reinforced with a webbing 1 at the periphery of the mattress, as shown in FIG. 4.

The three regions comprise a middle region B, a side regions A and C. The side regions can be able to be folded towards one surface, and flanks thereof can be mounted with a safety belt 14 thereon. Preferably, the thicknesses of the mattress cores in the three regions of the mattress are about the same.

Figure 2:
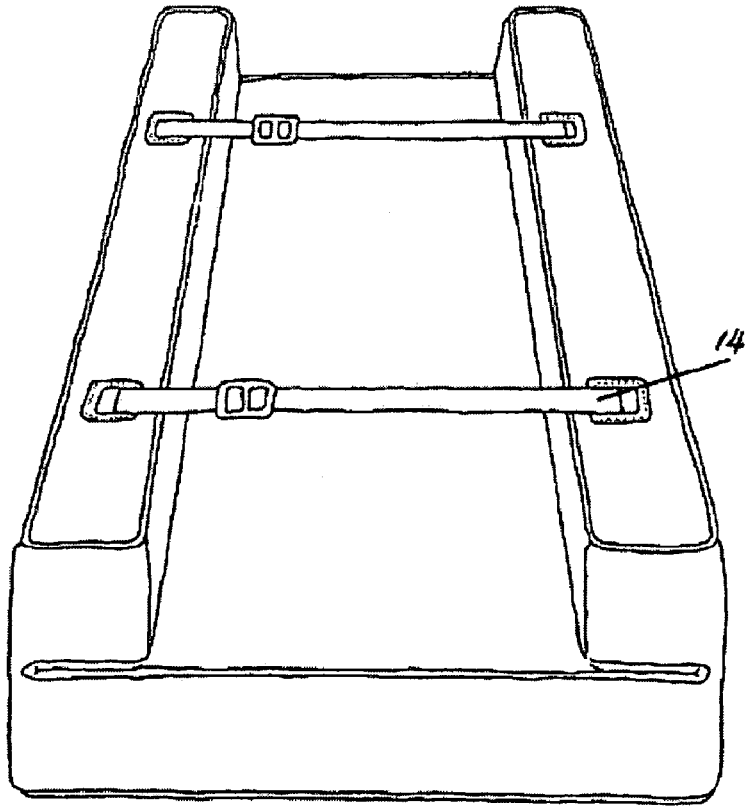
FIG. 2 is a schematic front view after the embodiment of FIG. 1 is folded upwards.

As shown in FIG. 1 and FIG. 2, the embodiment is divided into several regions, with a middle region and the two smaller flanks as a left region and a right region. On the left and right regions of the back of the unfolded mattress, body-fastening safety belts are provided. Moreover, the left and right regions can be folded upwards and the safety belts can be fastened together, thus forming a boat-shaped life-saving mattress.

Accordingly, a preferred embodiment provides a method of converting a mattress into a floating device, wherein the mattress comprises three regions, Regions A, B, and C, wherein Region B is adjacent to Region A on one side and adjacent to Region C on the opposite side; wherein the method comprises: folding Region A upwards perpendicularly from Region B; folding Region C upwards perpendicularly from Region B; and securing the positions of Regions A and C. In a preferred embodiment, the securing position is performed by fastening safety belts positioned on Regions A and C.

Figure 5:
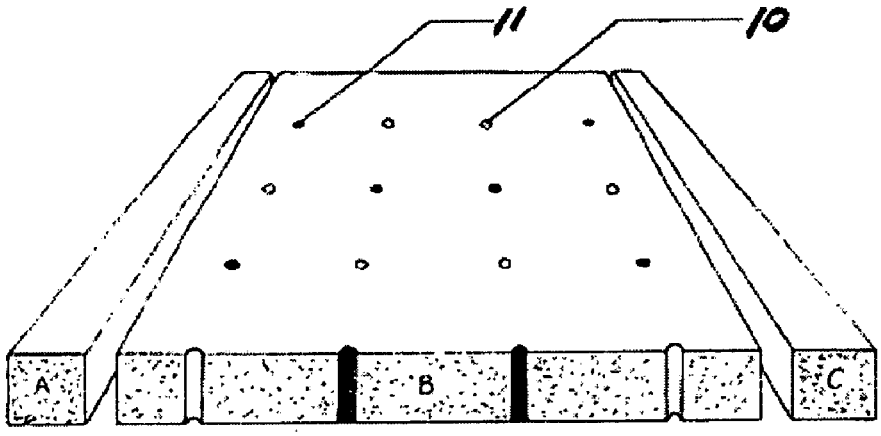
FIG. 5 is a schematic view of the structural principle after an EPE composite material is passed through with air holes and active carbon channels.

Referring to FIG. 4 and FIG. 5, the embodiment is divided into three regions A, B, and C. The embodiment comprises bulk solid and rigid cocofiber mattresses 5 and 7 and a prefabricated EPE composite material sandwiched layer 6. With variations in density, rigidity, and thickness, the embodiments can be altered to have certain overall properties. The sandwiched layer 6 is sandwiched between the two solid and rigid cocofiber mattresses 5 and 7. A specially made high elastic cocofiber mattress 4 is adhered firmly onto the solid and rigid cocofiber mattress 5. Integrating a high elastic cocofiber mattress into a cocofiber mattress core can vary the mattress property of softness and hardness.

The prefabricated active carbon layers 2 and 9 cover the surfaces of the cocofiber mattress core. Outside materials 3 and 8 are for packaging. Webbing 1 is for fixing the mattress edges. Air holes 10 and 13 pass through the sandwiched layer 6 and can enhance the air permeability of the mattress. Channels 11 and 12 are channels passing through sandwiched layer 6 and can be filled with active carbon of grain shape or strip shape. Thus, channels 11 and 12 provide the embodiment with features, such as moisture-proof, anti-bacterial, and deodorization.

Figure 3:
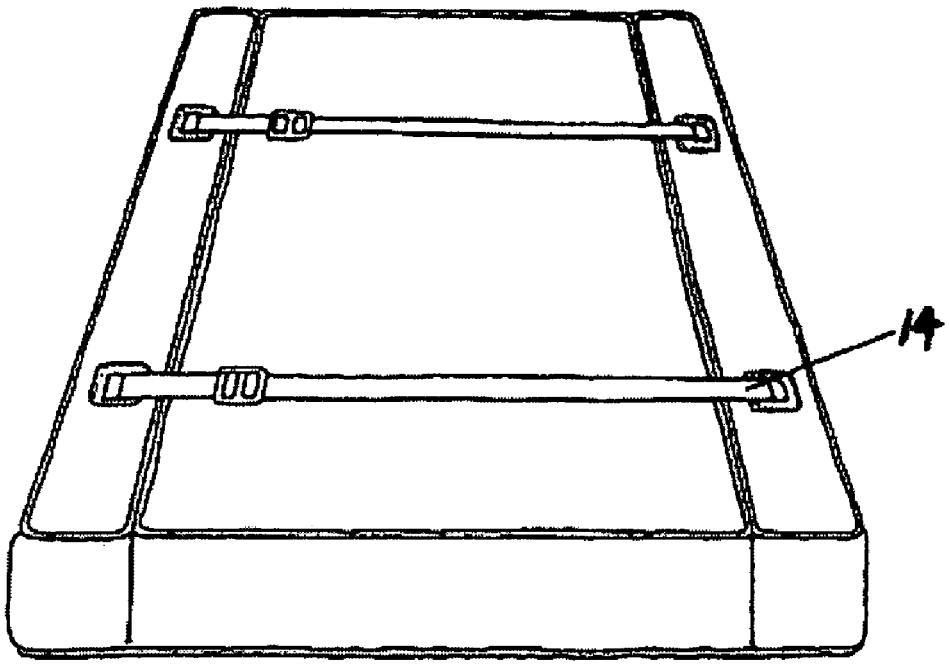
FIG. 3 is a schematic back view of an embodiment.
Figure 6:
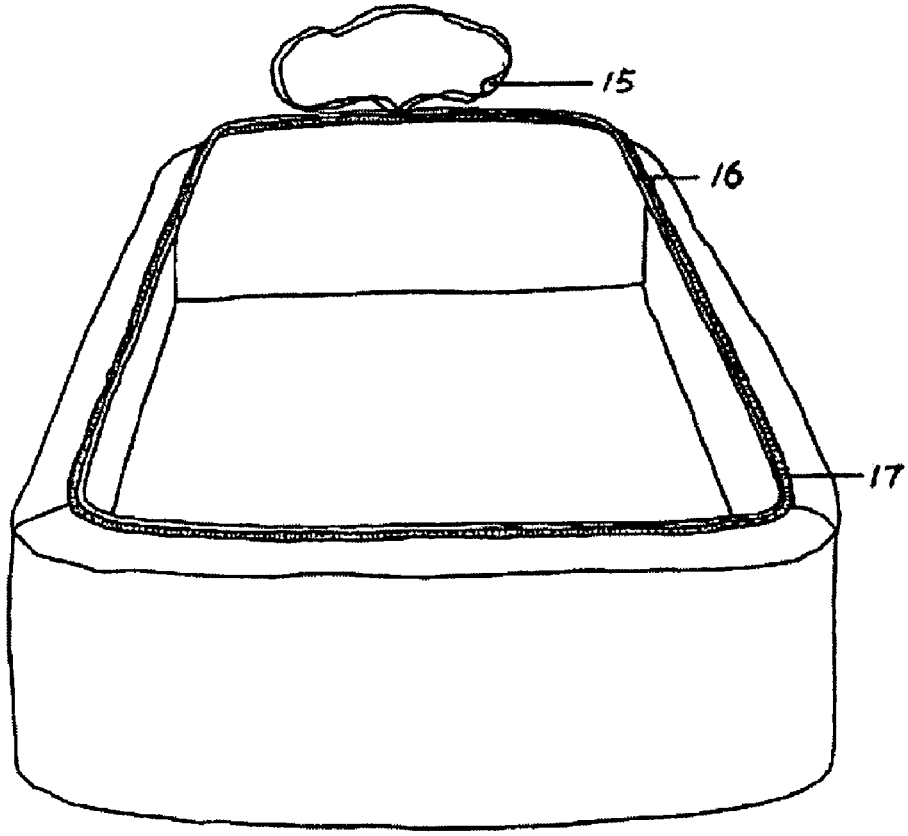
FIG. 6 is a schematic front view of a waterproof cover of the embodiment.
Figure 7:
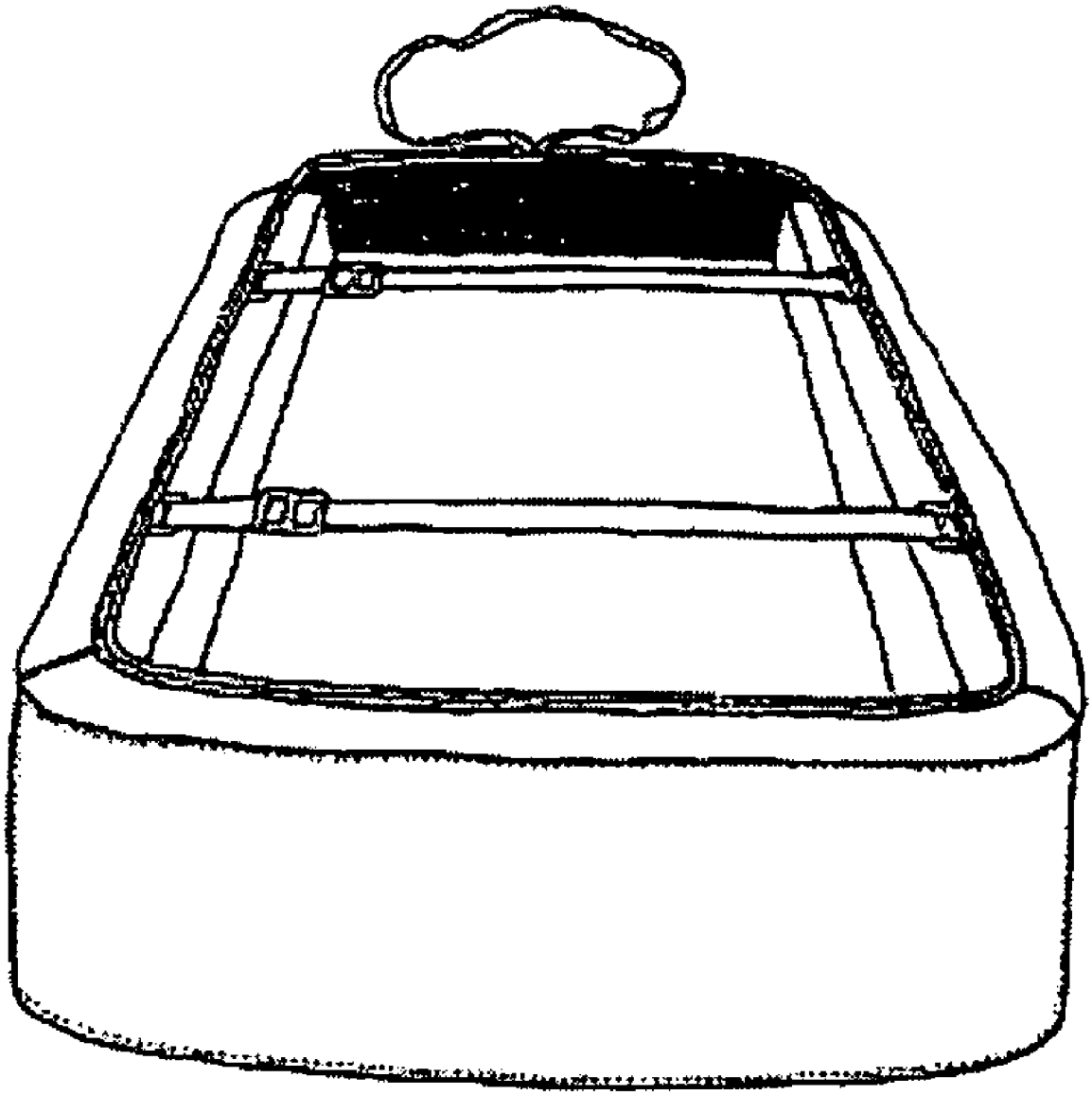
FIG. 7 is a schematic front view of the embodiment of FIG. 5 with the waterproof cover of the embodiment.

In FIG. 5, channel 11 is filled with active carbon and air hole 10 is hollow. In FIG. 2, safety belt 14 can be used in an emergency situation. In such a situation, safety belt 14 is fastened to act as a safety belt for life saving. In FIG. 3, safety belt 14 is on the back of the mattress, for fastening the A, B, and C regions of the mattress together. FIG. 6 shows a water-proof cover of the mattress, wherein 17 is an internal cloth path, for mounting with elastic bands, and wherein 16 is an external cloth path, for mounting with an inelastic safety rope 15.

Some advantages of the embodiments include providing a mattress for sleeping, which is environmentally conscious, moisture-proof, anti-bacterial, deodorizing, cool and ventilating, flat, and comfortable, and can be used variably as a soft or hard surface. As a life saving resource, the embodiment can float and can function as a boat. The embodiment can be characterized as not needing to be inflated, puncture-resistant, and resistant to collisions, as well as being able to be folded and unfolded quickly.

A preferred embodiment provides a mattress comprising a foldable mattress core. The mattress core is formed by two prefabricated solid and rigid cocofiber mattresses, with an ultra-thick polyvinyl EPE composite material layer, which has a high density and a specific gravity of less than about 1. The ultra-thick polyvinyl EPE composite material layer comprises air holes and channels filled with active carbon. The sandwiched layer comprising EPE composite material and the prefabricated upper and lower solid and rigid cocofiber mattresses can be integrated.

A specially-made high elastic cocofiber mattress can be adhered firmly onto one of the solid and rigid cocofiber mattresses, thereby forming a cocofiber mattress core. The solid and rigid cocofiber mattress can be adjusted with regard to support with avoidance of sinking of the mattress. Another specially-made high elastic cocofiber mattress can be added to customize the embodiment with proper softness according to varying desires of the consumers.

A prefabricated active carbon layer can be formed by distributing the fine active carbon of a grain shape or a strip shape evenly on the upper surface and lower surface of non-woven fabrics and integrating the materials. The prefabricated active carbon layer can cover the surface of the cocofiber mattress core to form an active carbon-cocofiber mattress core. Preferably, the prefabricated active carbon layer can cover the whole surface of the cocofiber mattress core.

The mattress core can be wrapped with outside packaging materials. The wrapping of mattress core with the outside packaging materials results in the embodiment being able to be flat or folded. In an embodiment, the active carbon-cocofiber mattress core can be divided into three regions. The active carbon-cocofiber mattress core can become a flat, foldable integrity by utilizing the three regions. As shown in FIG. 4, the flat, foldable integrity can be formed by wrapping the regions with outside packaging materials 3 and 8. The outside packaging material 3 connects the three regions. The outside packaging material 8 wraps on the underside of each region and on inner sides surrounding each region. Thus, the outside packaging material 8 wraps the sides of the clefts of the active carbon-cocofiber mattress core to separate each region, namely region A, B, and C.

The embodiment is divided into several regions, with a middle region and the two smaller flanks as the left region and the right region. On the left and right regions of the back of the unfolded mattress, body-fastening safety belts are provided. Moreover, the left and right regions can be folded upwards and the safety belts can be fastened together, thus forming a boat-shaped lifesaving mattress. Preferably, the thicknesses of the three regions can be the same, and the width of the right and left flanks can be at least larger than the thickness of the mattress, and both regions can be distributed on the long side of the middle region.

The safety belt has multiple functions. When the mattress is folded into a boat, it can serve as safety belts. When the mattress is unfolded, it can serve as an elastic band for tightening the two flanks and the middle portion from the back.

Many modifications and variations of the embodiments described herein may be made without departing from the scope, as is apparent to those skilled in the art. The specific embodiments described herein are offered by way of example only.

EXAMPLE 1

As light, flexible, and slightly elastic, EPE foaming material was chosen to be used in the embodiments. Cocofiber, a coconut fiber, which was processed by purification and sanitization, was prefabricated into solid and rigid bulk cocofiber mattresses 5 and 7, which meet the national hygienic and environmental standards. A prefabricated EPE composite material mattress served as sandwiched layer 6 with a certain requirements for density, rigidity, and thickness and was sandwiched and fixed between the two solid and rigid cocofiber mattresses 5 and 7. Said two solid and rigid cocofiber mattresses and the sandwiched layer 6 were adhered firmly into a whole. Then, a specially made high elastic cocofiber mattress was added onto the solid and rigid cocofiber mattress 5, and both are adhered together into a whole, thus forming a mattress core. The mattress core is designed to be divided into three regions A, B, and C, with the left and right regions A and C having a width of about 200 mm, with the middle region B about 1100 mm. Further, the prefabricated active carbon layers (formed by distributing the fine active carbon of a grain shape or a strip shape evenly on the upper and lower non-woven fabrics, and sticking them together as a whole) cover the whole surfaces of the three mattress regions A, B, and C, thus forming into an active carbon cocofiber mattress core. The three mattress regions are wrapped with mattress outside materials 3 and 8, and then reinforced with a webbing 1 at the periphery. Accordingly, the three mattress regions A, B, and C are connected as a whole, with the left and right regions being foldable or unfoldable. When unfolded, the three regions form one flat mattress. When folded from two sides, the embodiment acts as a lifesaving boat. The left and right sides of the back of the mattress were mounted with two safety belts 14. When employed at the back of the mattress, safety belts 14 are used for securing the left, middle, and right regions and serve as elastic bands. Though, in an emergency situation, the elastic bands 14 are loosened, and the two regions A and C are folded accordingly. Then the elastic bands 14 are fastened to act as safety belts.

EXAMPLE 2

A water-proof cover prefabricated with water-proof cloth, was provided. The water-proof cover was matched with the life-saving boat, provided by folding the mattress. The waterproof cover is made with tough and water-proof cloth. Two cloth paths are made beside the bar filling, for mounting the elastic bands and inelastic safety ropes respectively, to lock the bar filling, thus avoiding bar filling falling off. The "lifesaving boat" covered by the waterproof cover can prevent water from entering the cabin or reduce the water amount, so that the occupants feel more comfortable. In addition, it can increase the buoyancy of the lifesaving mattress, and decrease the traveling resistance of the lifesaving mattress.

EXAMPLE 3

Specifications of an embodiment are provided: length about 1900 mm; width about 1500 mm; thickness about 180 mm. Test Place: terrace of a building with an area of about 330 square meters. Depth of water: about 300 mm. The sample was soaked in water for about 6 months. The temperature of the water was between about 4-35° C. The manned buoyancy test was carried out through three steps in deep water of about 300 mm, with three people weighing about 200 kg standing on the embodiment, and the density of the EPE buoyancy material is about 28 kg/m$^3$. The data is shown in the following table:

TABLE 1

| | Test condition & results | | | | | |
|---|---|---|---|---|---|---|
| Test time | Specifications length * width * thickness (MM) | Days soaked in water (day) | Load (kg) | Draught depth (MM) | Buoyancy (kg/M$^3$) | Bearing safety standard (kg/M$^3$) |
| First time (Jun. 05, 2002) | 1900 * 1500 * 180 | 4 days | 6 persons (420 kg) | 150 | 818 | 600 kg |

TABLE 1-continued

| Test time | Test condition & results: Specifications length * width * thickness (MM) | Days soaked in water (day) | Load (kg) | Draught depth (MM) | Buoyancy ($kg/M^3$) | Bearing safety standard ($kg/M^3$) |
|---|---|---|---|---|---|---|
| Second time (Sep. 01, 2002) | 1900 * 1500 * 180 | About 90 days | 6 persons (420 kg) | 160 | 770 | 560 |
| Third time (Dec. 01, 2002) | 1900 * 1500 * 180 | About 180 days | 6 persons (420 kg) | 165 | 750 | 550 |

The sample was soaked in water outdoors for about 6 months with a load of about 400 kg, the draught depth of about 165 mm, and a bearing safety standard setting to about 500 $kg/m^3$. After being exposed to wind, rain, and sunlight for a long time, when checked, the sample is found to be almost the same as before, except that the mattress body was slightly softer than its state before soaking. The sample maintained a lifesaving function. With high-impact, puncture, and tension tests, the material is proven to be an ideal material for manufacturing the lifesaving mattress.

EXAMPLE 4

The embodiment comprises a foldable lifesaving mattress, with two pairs of safety belts mounted on both sides of the bottom. Specifications of an embodiment are provided: length of mattress: about 1900 mm; width: about 1500 mm; thickness: about 180 mm; the length of left and right regions: about 1900 mm, width: about 200 mm, thickness: about 180 mm.

Many modifications and variations of embodiments described herein may be made with departing from the scope, as is apparent to those skilled in the art. The specific embodiments described herein are offered by way of example only.

What is claimed is:

1. A multifunctional mattress comprising three Regions, Regions A, B, and C, each of the Regions comprising:

a mattress core comprising an upper rigid cocofiber layer, a lower rigid cocofiber layer, an ultra-thick layer sandwiched between the upper and lower cocofiber layers, with a specific gravity less than about 1;

a high elastic cocofiber layer on one of said rigid cocofiber layers;

a prefabricated active carbon layer on said mattress core; and prefabricated holes disposed within the cocofiber mattress core, the prefabricated holes comprising air holes and channels, wherein the air holes are filled only with air and the channels are filled with active carbon;

wherein Region B is adjacent to Region A on one side and adjacent to Region C on the opposite side; Region A is adapted to be folded upwards perpendicularly from Region B, Region C is adapted to be folded upwards perpendicularly from Region B, and Regions A and C are adapted to be fastened together after being folded upwards perpendicularly form Region B.

2. The multifunctional mattress according to claim 1, wherein the high elastic cocofiber mattress adheres onto the cocofiber mattress and the prefabricated active carbon layer completely covers the surface of the cocofiber mattress core, thus forming an active carbon-cocofiber mattress core.

3. The multifunctional mattress according to claim 1, wherein said prefabricated active carbon layer is formed by selecting fine active carbon of a grain shape or a strip shape, distributing the fine active carbon on an upper layer and a lower layer of non-woven fabric, and sticking the carbon and fabric together into a whole.

4. The multifunctional mattress according to claim 2, wherein the active carbon cocofiber mattress core further comprises outside packaging materials.

5. The multifunctional mattress according to claim 4, further comprising webbing at the periphery of the mattress.

6. The multifunctional mattress according to claim 1, wherein the thicknesses of the regions A,B and C are about the same.

7. The multifunctional mattress according to claim 1, wherein said ultra-thick sandwiched layer is made of EPE composite material.

8. The multifunctional mattress according to claim 1, wherein the regions A,B, and C are connected by hinged material.

9. A method of converting a mattress of claim 1 into a floating device, comprising: folding Region A upwards perpendicularly from Region B; folding Region C upwards perpendicularly from Region B; and securing the positions of Regions A and C.

10. The method according to claim 9, wherein the securing position is performed by fastening safety belts positioned on Regions A and C.

* * * * *